US006311705B1

(12) United States Patent
Ma

(10) Patent No.: US 6,311,705 B1
(45) Date of Patent: Nov. 6, 2001

(54) TILT CONTROL DEVICE OF LARGE-SIZED PARASOL

(76) Inventor: Mark Joen Shen Ma, 16633 Laurelbrook Way, Cerritos, CA (US) 90703

( * ) Notice: Subject to any disclaimer, the term of this patent is extended or adjusted under 35 U.S.C. 154(b) by 0 days.

(21) Appl. No.: 09/644,238

(22) Filed: Aug. 23, 2000

(51) Int. Cl.[7] ..... A45B 17/00
(52) U.S. Cl. ..... 135/20.3; 248/514
(58) Field of Search ..... 135/20.3, 20.1, 135/909, 74; 248/514

(56) References Cited

U.S. PATENT DOCUMENTS

| | | | | |
|---|---|---|---|---|
| 2,475,406 | * | 7/1949 | Russell | 135/74 |
| 2,607,363 | * | 8/1952 | Frey | 135/74 |
| 3,142,307 | * | 7/1964 | Danciart et al. | 135/20.3 |
| 3,145,720 | * | 8/1964 | Torii | 135/20.3 |
| 3,150,671 | * | 9/1964 | Frey | 135/20.3 |
| 3,175,568 | * | 3/1965 | Kafka | 135/20.3 |
| 3,311,119 | * | 3/1967 | Pearllstine | 135/20.3 |
| 4,132,236 | * | 1/1979 | Petersen et al. | 135/20.3 X |
| 4,674,522 | * | 6/1987 | Ma | 135/20.3 |
| 4,697,606 | * | 10/1987 | Ma | 135/20.3 |
| 6,230,724 | * | 5/2001 | Lai | 135/20.3 |

FOREIGN PATENT DOCUMENTS

| | | | | |
|---|---|---|---|---|
| 2259192 | * | 6/1974 | (DE) | 135/20.3 |

* cited by examiner

*Primary Examiner*—Robert Canfield
(74) *Attorney, Agent, or Firm*—Rosenberg, Klein & Lee

(57) ABSTRACT

A tilt control device is incorporated in a parasol for controlling tilting angle of a canopy of the parasol with respect to a central post of the parasol. The central post includes an upper segment to which the canopy is attached and a lower segment pivoted to the upper segment fir supporting the canopy. The tilt control device includes an operating ring rotatably mounted on the lower segment and forming an inner ring gear. A transmission shaft has a lower end forming an input gear mating the inner ring gear and an upper end forming a worm. A gear system is mounted to the second segment, including an output gear mounted to the pivotal pin of the upper segment and fixed to the upper segment and a worm gear mating the worm whereby rotation of the operating ring is transferred to the output gear via the transmission shaft and the gear system for moving the upper segment with respect to the lower segment.

5 Claims, 4 Drawing Sheets

TILT CONTROL DEVICE OF LARGE-SIZED PARASOL

FIELD OF THE INVENTION

The present invention generally relates to a parasol, such as a beach parasol, and in particular to a device for controlling the orientation or tilting angle of the canopy of a large-sized parasol.

BACKGROUND OF THE INVENTION

A large-sized parasol, such as a beach parasol, usually includes an upright central post on a top end of which a large-sized canopy is attached. Some of the large-sized parasols are devised to control the orientation or tilting angle of the canopy for achieving most desired sun-shading effect.

A conventional device for controlling and adjusting the tilting angle of a parasol canopy comprises a pivotal connection between upper and lower segments of a central post of the parasol. Spring-biased retaining means is provided in the central post for manually controlling the tilt of the canopy. Such a conventional control device, however, is difficult to operate for it requires an operator to control and operate the device with both hands. Furthermore, the canopy can only be retained in a limited number of angular positions with respect to the central post. Stepless control is in general impossible.

Another conventional device employs a rope-and-pulley system which allows a stepless control/adjustment of the tilting angle of the canopy of a parasol. However, such a rope-and-pulley system requires a number of parts, complicating the structure, increasing costs and reducing liablility. The service life may thus be shortened and frequent maintenance is required.

It is thus desirable to provide a tilt control device for controlling the tilting angle of a canopy of a large-sized parasol which overcomes the above-discussed problems.

SUMMARY OF THE INVENTION

Accordingly, an object of the present invention is to provide a parasol tilt control device having a simple and reliable structure.

Another object of the present invention is to provide a parasol tilt control device allowing a stepless control of tilting angle of the parasol.

A further object of the present invention is to provide a parasol tilt control device capable to be operated by a single hand.

To achieve the above objects, in accordance with the present invention, there is provided a tilt control device to be incorporated in a parasol for controlling tilting angle of a canopy of the parasol with respect to a central post of the parasol. The central post comprises an upper segment to which the canopy is attached and a lower segment pivoted to the upper segment fir supporting the canopy. The tilt control device comprises an operating ring rotatably mounted on the lower segment and forming an inner ring gear. A transmission shaft has a lower end forming an input gear mating the inner ring gear and an upper end forming a worm. A gear system is mounted to the second segment, including an output gear mounted to the pivotal pin of the upper segment and fixed to the upper segment and a worm gear mating the worm whereby rotation of the operating ring is transferred to the output gear via the transmission shaft and the gear system for moving the upper segment with respect to the lower segment.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 2:
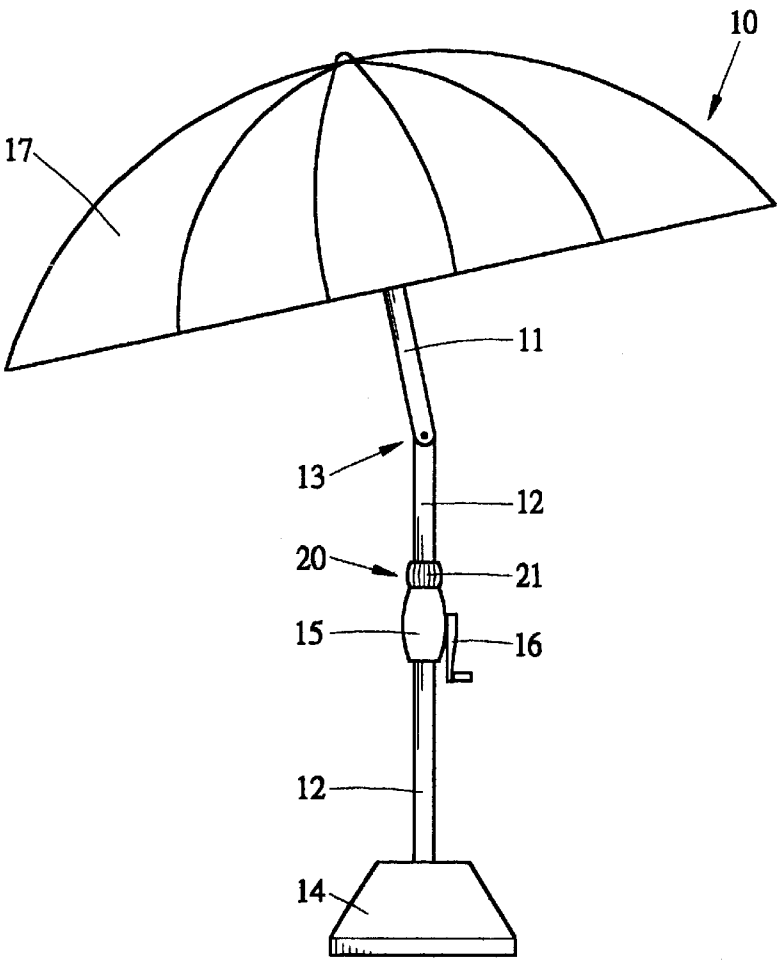
FIG. 2 is similar to FIG. 1 but showing the parasol in a tilting condition.
Figure 1:
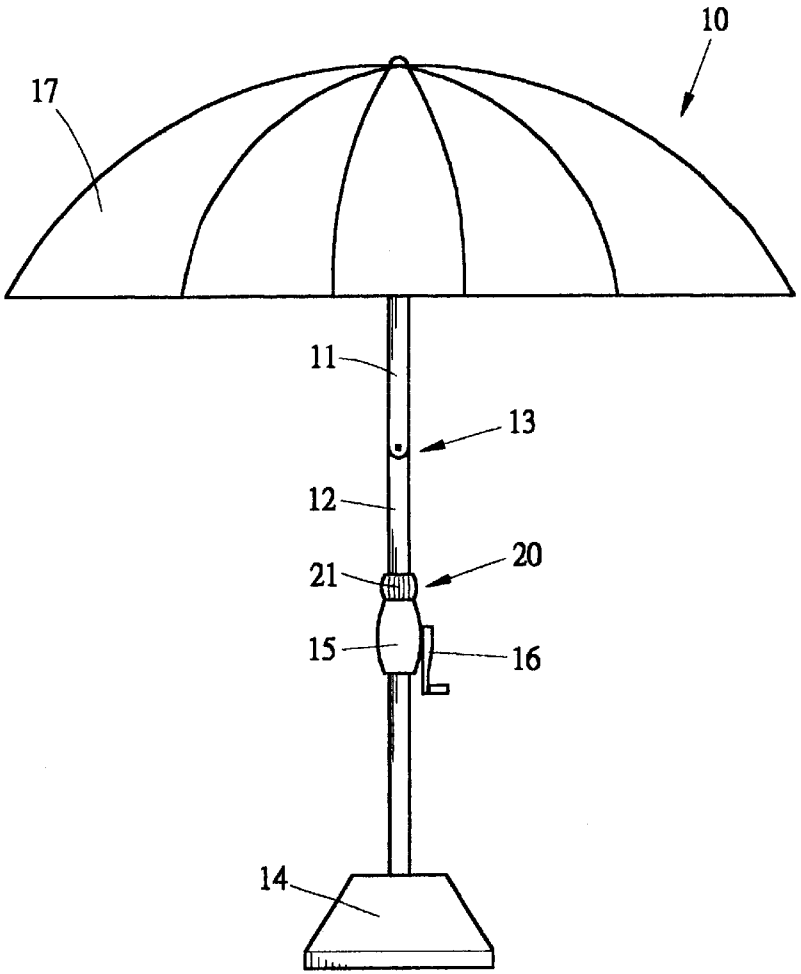
FIG. 1 is a side elevational view of a large-sized parasol in a fully open condition in which a tilt control device in accordance with the present invention is incorporated.

With reference to the drawings and in particular to FIGS. 1 and 2, wherein a large-sized parasol, generally designated with reference numeral 10, is shown, the parasol 10 comprises a central post including upper and lower segments 11, 12 and a canopy 17 attached to a top end of the upper segment 11. Preferably, the parasol 10 comprises a base 14 to which a lower end of the lower segment 12 of the central post is fixed for supporting the central post in an upright condition. The upper and lower segments 11, 12 are movably connected together by a pivotal connection 13 whereby the upper segment 11 is rotatable with respect to the lower segment 12 for tilting the canopy 17.

A canopy control device 15 is mounted to the lower segment 12 of the central post for opening/closing the canopy 17. Preferably, the canopy control device 15 is manually operated by a crank arm 16 and an associated mechanism. Such a mechanism and crank arm are well known to those having ordinary skills whereby no further detail will be needed herein.

Figure 3:
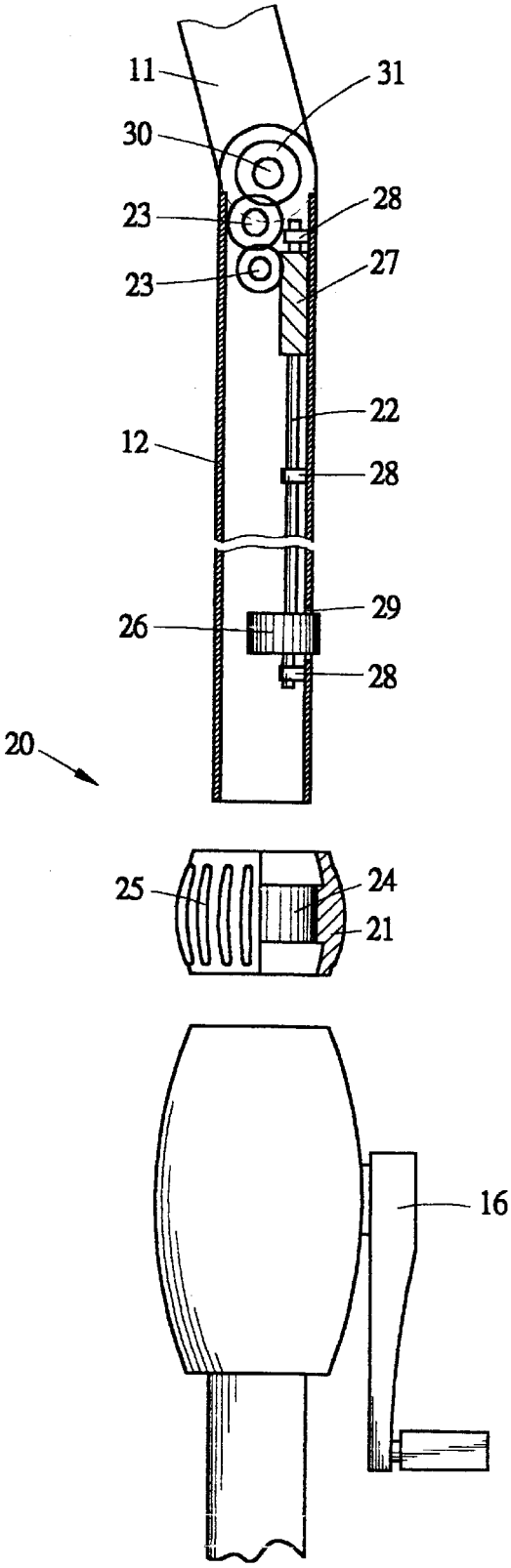
FIG. 3 is an exploded, partially cut away, of a portion of a central post of the parasol for illustrating the tilt control device of the present invention.
Figure 4:
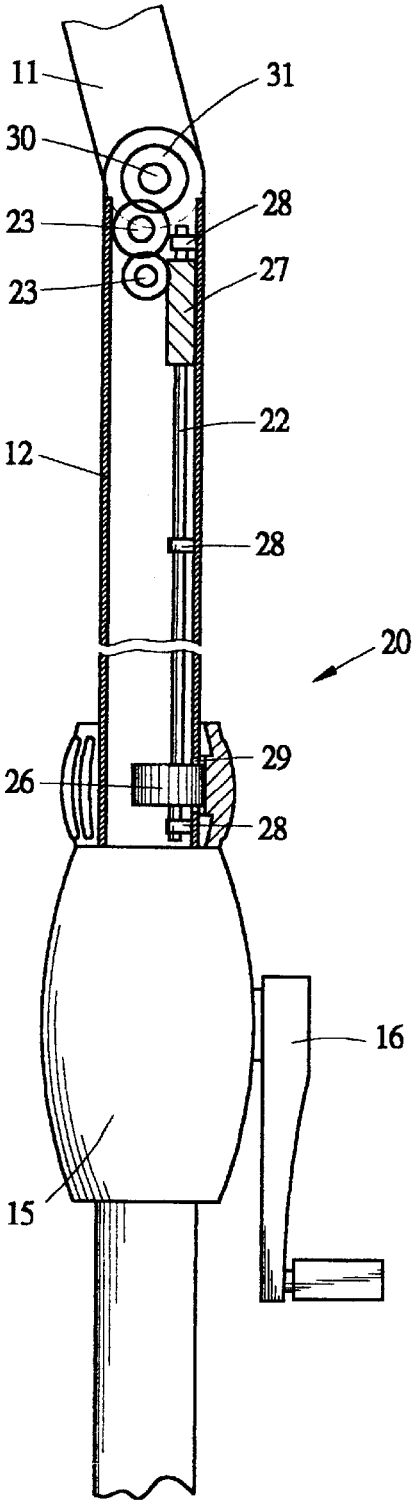
FIG. 4 is an assembled view of FIG. 3.

Also referring to FIGS. 3 and 4, in accordance with the present invention, a tilt control device 20 is incorporated in the central post for controlling tilting angle of the canopy 17 with respect to the central post. The tilt control device 20 comprises an operating ring 21, a transmission shaft 22 and an output gear system 23. The operating ring 21 is substantially co-axially mounted on and thus encompassing the lower segment 12 of the central post and rotatable with respect thereto. The operating ring 21 forms an inner ring gear 24 on an inside surface thereof and a plurality of raised ribs 25 on an outside surface thereof for facilitating grasping and operating.

The lower segment 12 forms an interior space (not labeled) for accommodating the transmission shaft 22. Preferably, the upper and lower segments 11, 12 are tubular members. The shaft 22 is rotatably received in the lower segment 12 and retained in positioned by retention elements 28 fixed in the lower segment 12 of the central post. An input gear 26 is formed on a lower end of the shaft 22 and thus accommodated in the lower segment 12. The input gear 26 partially extends beyond the lower segment of the central post through a slot 29 defined in the lower segment 12 for mating and driving engagement with the inner ring gear 24. A worm 27 is formed on an opposite upper end of the shaft 22.

The output gear system 23 comprises a gear train having a worm gear (not labeled) mating the worm 27 for being driven thereby and an output gear 31 mechanically coupled to the pivotal connection 13 of the central post for moving the upper segment 11 with respect to the lower segment 12.

Figure 5:
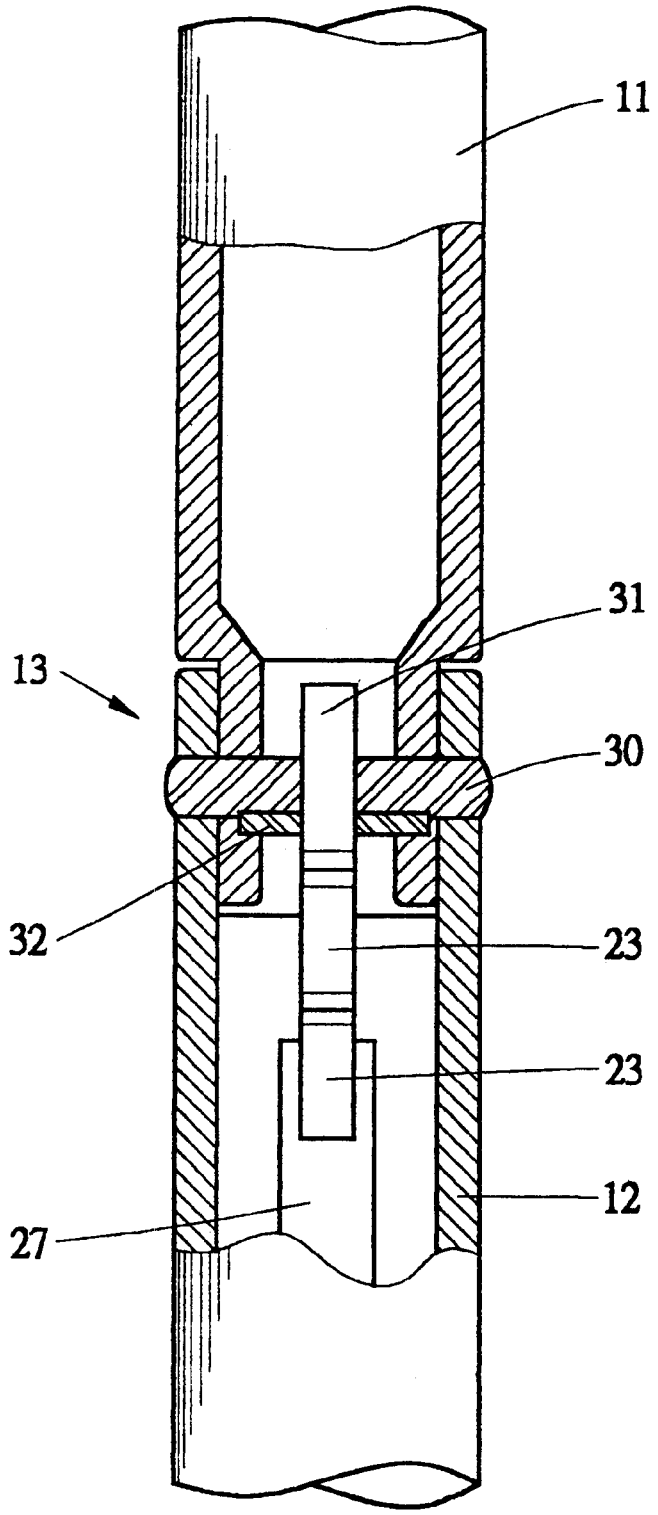
FIG. 5 is a side elevational view, partially broken, of a portion of the central post illustrating pivotal connection between upper and lower segments of the central post.

Also referring to FIG. 5, the output gear 31 that is mechanically connected to the worm gear of the gear system 23 is co-axially keyed to a pivotal pin 30 of the pivotal connection 13 by a key 32. The key 32 fixes the upper segment 12, the output gear 31 and the pivotal pin 30 together whereby when the output gear 31 is rotated by the transmission shaft 22, the upper segment 11 is driven to tilt with respect to the lower segment 12.

A user may manually rotate the operating ring 21 around the central post. The rotation of the operating ring 21 is transferred to the output gear system 23 via the shaft 22 which in turn causes the upper segment 11 and the canopy 17 to tilt. The worm-worm gear arrangement between the gear system 23 and the shaft 22 facilitates reducing operation speed of the gear system 23 while increasing output torque.

Figure 6:
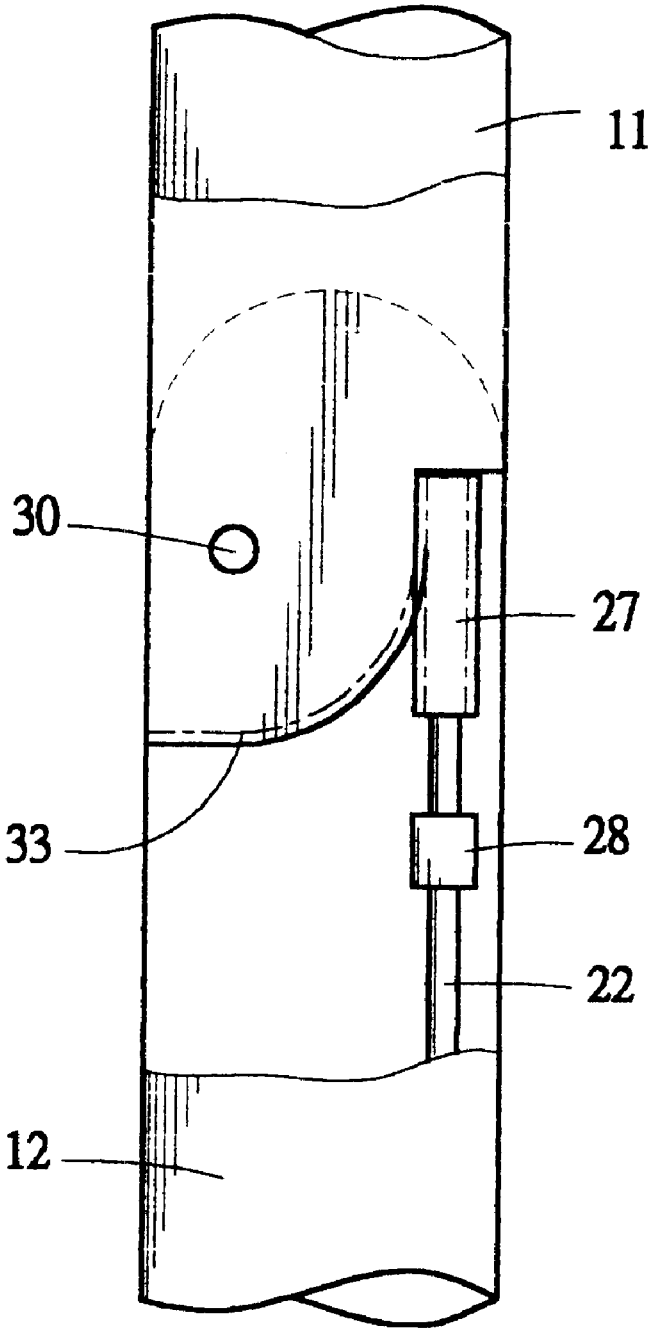
FIG. 6 is similar to FIG. 5 but showing another embodiment of the pivotal connection between the upper and lower segments of the central post.

FIG. 6 shows another embodiment of the pivotal connection 13 and the output gear system 23. The output gear system 23 of this embodiment comprises sector gears 33 formed on a lower end of the upper segment 11 for driving and mating engagement with the worm 27 whereby the upper segment 11 is directly driven by the shaft 22. This reduces the number of parts required for the tilting operation.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A tilt control device for controlling tilting angle between first and second segments of a central post of a parasol with respect each other for adjusting orientation of a canopy of the parasol, the tilt control device comprising:

an operating ring rotatably mounted to the first segment of the central post, the operating ring having an inner surface forming an inner ring gear;

a transmission shaft having a first end forming an input gear mating the ring gear and a second end forming a worm; and an output gear system mechanically coupled to the second segment, the output gear system comprising at least a first toothed member drivingly engaging the worm for being driven thereby to move the second segment with respect to the first segment.

2. The tilt control device as claimed in claim 1, wherein the operating ring has an outside surface on which raised ribs are formed.

3. The tilt control device as claimed in claim 1, wherein the first segment forms an interior space in which the input gear is accommodated, the operating ring being rotatably encompassing the first segment, the first segment defining a slot through which the input gear partially extending beyond the first segment for mating engagement with the inner ring gear of the operating ring.

4. The tilt control device as claimed in claim 1, wherein the output gear system comprises a gear train including an output gear co-axially fixed to a pivotal pin which is fixed to the first segment but rotatable with respect to the second segment whereby the first segment is driven to rotate with respect to the second segment by the output gear system.

5. The tilt control device as claimed in claim 1, wherein the output gear system comprises at least one sector gear formed on the second segment for matingly and drivingly engaging the worm.

* * * * *